US009303533B2

(12) United States Patent
Palmer

(10) Patent No.: US 9,303,533 B2
(45) Date of Patent: Apr. 5, 2016

(54) MIXING ASSEMBLY AND METHOD FOR COMBINING AT LEAST TWO WORKING FLUIDS

(71) Applicant: HARRIS CORPORATION, Melbourne, FL (US)

(72) Inventor: William R. Palmer, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 215 days.

(21) Appl. No.: 14/138,903

(22) Filed: Dec. 23, 2013

(65) Prior Publication Data

US 2015/0176436 A1 Jun. 25, 2015

(51) Int. Cl.
*F01K 25/06* (2006.01)
*F01K 7/34* (2006.01)
(Continued)

(52) U.S. Cl.
CPC . *F01K 19/02* (2013.01); *F01K 7/02* (2013.01); *F01K 7/16* (2013.01); *F01K 17/00* (2013.01); *F01K 21/04* (2013.01); *F01K 25/06* (2013.01); *F01K 25/08* (2013.01)

(58) Field of Classification Search
CPC ..... F01K 19/02; F01K 25/08; F01K 25/06; F01K 7/16; F01K 21/04; F01K 7/02; F01K 17/00
USPC ..... 60/649, 653, 677–680, 676
See application file for complete search history.

(56) References Cited

U.S. PATENT DOCUMENTS 945,742 A 1/1910 Boeckel et al.
3,007,306 A 11/1961 Martin et al.
(Continued)

FOREIGN PATENT DOCUMENTS

DE 3327838 A1 12/1983
DE 198 04 845 A1 8/1999
(Continued)

OTHER PUBLICATIONS

International Preliminary Report on Patentability mailed Dec. 4, 2014 for International Patent Appln. No. PCT/US2013/0141506 to Harris Corporation.
(Continued)

*Primary Examiner* — Hoang Nguyen
(74) *Attorney, Agent, or Firm* — Fox Rothschild, LLP; Robert J. Sacco; Carol E. Thorsiad-Forsyth

(57) ABSTRACT

A method for producing work from heat including mixing a first working fluid $F_1$ vapor with a second working fluid $F_2$ vapor to form a third working fluid $F_3$; atomizing and/or vaporizing a liquid into the third working fluid $F_3$ to define a saturated working fluid; and expanding the saturated working fluid to perform useful work. A high pressure $F_1(2)$ portion of the first working fluid $F_1$ may be expanded prior to the mixing step while the $F_2$ vapor is compressed prior to the mixing step. The steps of compressing the $F_2$ vapor and expanding the high pressure $F_1(2)$ portion of the first working fluid $F_1$ may be carried out by an integral compressor and expander assembly (204/209). The integral compressor and expander assembly (204/209) may be positioned within a combined mixer assembly (300) with an internal mixing chamber (206) and outlets (375, 351) of both the compressor (204) and expander (209) are directed toward the mixing chamber 206.

24 Claims, 5 Drawing Sheets

(51) Int. Cl.

| | |
|---|---|
| ***F01K 19/02*** | (2006.01) |
| ***F01K 17/00*** | (2006.01) |
| ***F01K 7/02*** | (2006.01) |
| ***F01K 7/16*** | (2006.01) |
| ***F01K 21/04*** | (2006.01) |
| ***F01K 25/08*** | (2006.01) |

(56) References Cited

U.S. PATENT DOCUMENTS

| | | | | | |
|---|---|---|---|---|---|
| 3,070,348 | A | | 12/1962 | Stewart | |
| 3,070,349 | A | | 12/1962 | Stewart | |
| 3,636,706 | A | | 1/1972 | Minto | |
| 3,704,570 | A | | 12/1972 | Gardenier | |
| 3,834,133 | A | | 9/1974 | Bow | |
| 3,935,710 | A | | 2/1976 | Dickinson | |
| 3,973,865 | A | | 8/1976 | Mugele | |
| 4,009,587 | A | | 3/1977 | Robinson, Jr. et al. | |
| 4,027,993 | A | * | 6/1977 | Wolff | 415/1 |
| 4,106,294 | A | | 8/1978 | Czaja | |
| 4,122,680 | A | * | 10/1978 | Isshiki et al. | 60/649 |
| 4,196,594 | A | | 4/1980 | Abom | |
| 4,252,543 | A | | 2/1981 | Giles | |
| 4,258,551 | A | * | 3/1981 | Ritzi | 60/654 |
| 4,283,211 | A | | 8/1981 | Ehrlich et al. | |
| 4,287,138 | A | | 9/1981 | Buckner | |
| 4,291,538 | A | | 9/1981 | Husain et al. | |
| 4,366,675 | A | | 1/1983 | Nishioka | |
| 4,372,124 | A | * | 2/1983 | Newton et al. | 60/648 |
| 4,372,759 | A | | 2/1983 | Sederquist et al. | |
| 4,448,030 | A | | 5/1984 | Moss | |
| 4,484,446 | A | | 11/1984 | Goldsberry | |
| 4,548,043 | A | | 10/1985 | Kalina | |
| 4,569,207 | A | | 2/1986 | James | |
| 4,660,511 | A | | 4/1987 | Anderson | |
| 4,905,481 | A | | 3/1990 | Scaringe et al. | |
| 4,926,643 | A | | 5/1990 | Johnston | |
| 4,935,221 | A | | 6/1990 | Bronfenbrenner et al. | |
| 5,137,681 | A | | 8/1992 | Dougherty | |
| 5,269,148 | A | | 12/1993 | Ludwig | |
| 5,444,981 | A | | 8/1995 | Kakovitch | |
| 5,476,525 | A | | 12/1995 | Bekedam | |
| 5,577,881 | A | | 11/1996 | Hablanian | |
| 5,622,055 | A | | 4/1997 | Mei et al. | |
| 5,644,911 | A | | 7/1997 | Huber | |
| 5,727,393 | A | | 3/1998 | Mahmoudzadeh | |
| 5,832,728 | A | * | 11/1998 | Buck | 60/407 |
| 6,032,467 | A | | 3/2000 | Oshita et al. | |
| 6,141,955 | A | | 11/2000 | Akiyama et al. | |
| 6,145,295 | A | | 11/2000 | Donovan et al. | |
| 6,250,105 | B1 | | 6/2001 | Kimble | |
| 6,413,484 | B1 | | 7/2002 | Koch | |
| 6,490,865 | B2 | | 12/2002 | Pauly | |
| 6,769,256 | B1 | | 8/2004 | Kalina | |
| 6,884,021 | B2 | | 4/2005 | Saito | |
| 7,010,920 | B2 | | 3/2006 | Saranchuk et al. | |
| 7,096,665 | B2 | | 8/2006 | Stinger et al. | |
| 7,600,961 | B2 | | 10/2009 | Abdallah | |
| 7,806,649 | B2 | | 10/2010 | Ishikawa et al. | |
| 7,935,180 | B2 | | 5/2011 | Weber | |
| 8,176,724 | B2 | | 5/2012 | Smith | |
| 8,262,339 | B2 | | 9/2012 | Chien | |
| 8,631,658 | B2 | * | 1/2014 | MacAdam et al. | 60/775 |
| 8,726,635 | B1 | | 5/2014 | Dale | |
| 2002/0162330 | A1 | | 11/2002 | Shimizu et al. | |
| 2004/0123609 | A1 | | 7/2004 | Gottlieb | |
| 2004/0182082 | A1 | | 9/2004 | Saranchuk et al. | |
| 2005/0132713 | A1 | | 6/2005 | Neary | |
| 2009/0241860 | A1 | | 10/2009 | Monacelli et al. | |
| 2010/0043433 | A1 | | 2/2010 | Kelly | |
| 2010/0051441 | A1 | | 3/2010 | Vane et al. | |
| 2010/0055010 | A1 | | 3/2010 | Froderberg et al. | |
| 2010/0071368 | A1 | | 3/2010 | Kaplan et al. | |
| 2010/0077752 | A1 | * | 4/2010 | Papile | 60/641.8 |
| 2010/0242476 | A1 | | 9/2010 | Ast et al. | |
| 2011/0000205 | A1 | | 1/2011 | Hauer et al. | |
| 2011/0209474 | A1 | | 9/2011 | Leibowitz | |
| 2011/0239700 | A1 | | 10/2011 | Hasse et al. | |
| 2012/0139470 | A1 | | 6/2012 | Huff et al. | |
| 2012/0151950 | A1 | | 6/2012 | Jagusztyn | |
| 2012/0255304 | A1 | | 10/2012 | Li et al. | |

FOREIGN PATENT DOCUMENTS

| | | | |
|---|---|---|---|
| DE | 10227709 | A1 | 2/2003 |
| JP | 2000282810 | A | 10/2000 |
| JP | 2001-108201 | A | 4/2001 |
| KR | 101045802 | B1 | 7/2011 |
| WO | 02/073007 | A2 | 9/2002 |
| WO | 2004/033859 | A1 | 4/2004 |
| WO | 2006/028444 | A1 | 3/2006 |
| WO | 2006/105815 | A1 | 10/2006 |
| WO | 2012/076902 | A1 | 6/2012 |
| WO | 2012151055 | A2 | 11/2012 |
| WO | 2013/043999 | A2 | 3/2013 |

OTHER PUBLICATIONS

International Preliminary Report on Patentability mailed Jan. 8, 2015 for International Patent Appln. No. PCT/US2013/047750 to Harris Corporation.

International Preliminary Report on Patentability mailed Feb. 5, 2015 for International Patent Appln. No. PCT/US2013/051857 to Harris Corporation.

International Preliminary Report on Patenability mailed Apr. 3, 2014, in applicaiton Serial No. PCT/US2012/056524 in the name of Harris Corporation.

International Search Report and Written Opinion mailed Nov. 16, 2012; Application No. PCT/US2012/034199 in the name of Harris Corporation.

Information about Related Patents and Patent Applications, see section 6 of the accompanying Information Disclosure Statement Letter, which concerns Related Patents and Patent Applications. Dec. 23, 2013.

Reference to U.S. Appl. No. 13/098,603, filed May 2, 2011.

Reference to U.S. Appl. No. 13/859,106, filed Apr. 9, 2013.

Reference to U.S. Appl. No. 14/139,094, filed Dec. 23, 2013.

Reference to U.S. Appl. No. 13/859,355, filed Apr. 9, 2013.

Reference to U.S. Appl. No. 13/859,409, filed Apr. 9, 2013.

Reference to U.S. Appl. No. 13/533,497, filed Jun. 26, 2012.

Reference to U.S. Appl. No. 13/239,674, filed Sep. 22, 2011.

Reference to U.S. Appl. No. 13/477,394, filed May 22, 2012.

Reference to U.S. Appl. No. 13,556,387, filed Jul. 24, 2012.

International Search Report and Written Opinion issued on Oct. 9, 2013 in PCT/US2012/056524 to Harris Corporation (11 pages).

International Search Report and Written Opinion mailed Oct. 10, 2013 for International Patent Appln. No. PCT/US2013/0141506 to Harris Corporation (13 pages).

International Search Report and Written Opinion mailed Oct. 9, 2013 for International Patent Appln. No. PCT/US2013/051857 (11 pages).

International Search Report and Written Opinion mailed Oct. 9, 2013 in International Application No. PCT/US2013/047750 (11 pages).

* cited by examiner

MIXING ASSEMBLY AND METHOD FOR COMBINING AT LEAST TWO WORKING FLUIDS

BACKGROUND OF THE INVENTION

1. Statement of the Technical Field

The invention concerns a mixer assembly and method for mixing various vaporized fluid. More particularly, the invention concerns a mixer assembly and method for providing a saturated combined working fluid.

2. Description of the Related Art

Heat engines and the like use energy provided in the form of heat to perform mechanical work. In some such applications, it is desirable to combine two or more working fluids prior to extraction of work from the combined fluid, for example via an expander. The pressure, temperature and construct of the working fluid mixture entering the expander is key for establishing the performance capability. It is understood that the expander performance is highly dependent on the energy content and expansion profile of the working fluid mixture flow. It would be understood by those skilled in the art that the volumetric flow rate, density, pressure, and temperature are important to establish the performance characteristics of the expander. These parameters can be established and controlled by controlling the characteristics of the working fluids, for example, by expanding, compressing or otherwise operating on the fluids before or after they are combined.

SUMMARY OF THE INVENTION

Embodiments of the invention concern a method for producing work from heat including mixing a first working fluid $F_1$ vapor with a second working fluid $F_2$ vapor to form a third working fluid $F_3$; atomizing and/or vaporizing a liquid into the third working fluid $F_3$ to define a saturated working fluid; and expanding the saturated working fluid to perform useful work. A high pressure $F_1(2)$ portion of the first working fluid $F_1$ may be expanded prior to the mixing step while the $F_2$ vapor is compressed prior to the mixing step. The steps of compressing the $F_2$ vapor and expanding the high pressure $F_1(2)$ portion of the first working fluid $F_1$ may be carried out by an integral compressor and expander assembly. The integral compressor and expander assembly may be positioned within a combined mixer assembly with an internal mixing chamber and outlets of both the compressor and expander are directed toward the mixing chamber.

The invention also includes a system for producing work from heat in a fluid flow including a mixing chamber configured to mix a first working fluid $F_1$ vapor with a second working fluid $F_2$ vapor to form a third working fluid $F_3$ and to facilitate a transfer of thermal energy directly between the $F_1$ vapor and the $F_2$ vapor, exclusive of any intervening structure. A nozzle assembly is configured to vaporize and/or atomize a liquid into the third working fluid $F_3$ to form a saturated working fluid. An expander is configured to expand the saturated working fluid to perform work. The system may further include an initial expander configured to expand a portion $F_1(2)$ of the first working fluid $F_1$ before it is communicated to the mixing chamber and a compressor configured to compress the $F_2$ working fluid before it is communicated to the mixing chamber. In at least one embodiment, the compressor and the initial expander are an integral unit and the integral compressor and expander assembly are positioned within an outer housing member of a combined mixer assembly and an inner housing member thereof defines the mixing chamber, and outlets of both the compressor and expander are directed toward the mixing chamber.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The invention concerns a combined mixer assembly 300 for use in a Hybrid Thermal Cycle (HTC), or other energy transfer operations utilizing fluids $F_1$, $F_2$, and $F_3$ where $F_3$ is comprised of a mixture of fluids $F_1$ and $F_2$. The $F_1$ fluid is a fluid construct that is advantageously selected so that it is capable of transitioning from a liquid to a vapor in some parts of the cycle, and from a vapor to a liquid during other portions of the cycle. Fluid $F_2$ is preferably selected so that it remains vaporous throughout the cycle. The $F_1$ fluid is mixed with the $F_2$ fluid in parts of the cycle to form the $F_3$ fluid. Later in the cycle the $F_1$ fluid is separated from the $F_3$ fluid. Following a compression portion of the cycle during which $F_2$ is compressed, there is an expansion part of the cycle during which $F_3$, comprised of a mixture of $F_1$ and $F_2$, is expanded. During this expansion, the $F_1$ fluid functions to support or maintain the temperature of the $F_2$ fluid, preventing it from cooling more rapidly than without the latent heat that is available from the $F_1$ fluid. If the $F_2$ fluid were expanded without the portion of the $F_1$ fluid it would cool more rapidly, having less capacity to perform work. This characteristic or effect in the cycle is desirable as it enables the fluid mixture $F_3$ to perform work for a longer period of time during expansion. This ability of $F_1$ to effectively delay the cooling of $F_2$ essentially ends when the $F_1$ fluid reaches a point where it transitions from a vapor back into a liquid. At the end of the expansion process, at least a portion of the $F_1$ fluid condenses out of the $F_3$, leaving a residual portion, which is $F_2$.

Figure 1:
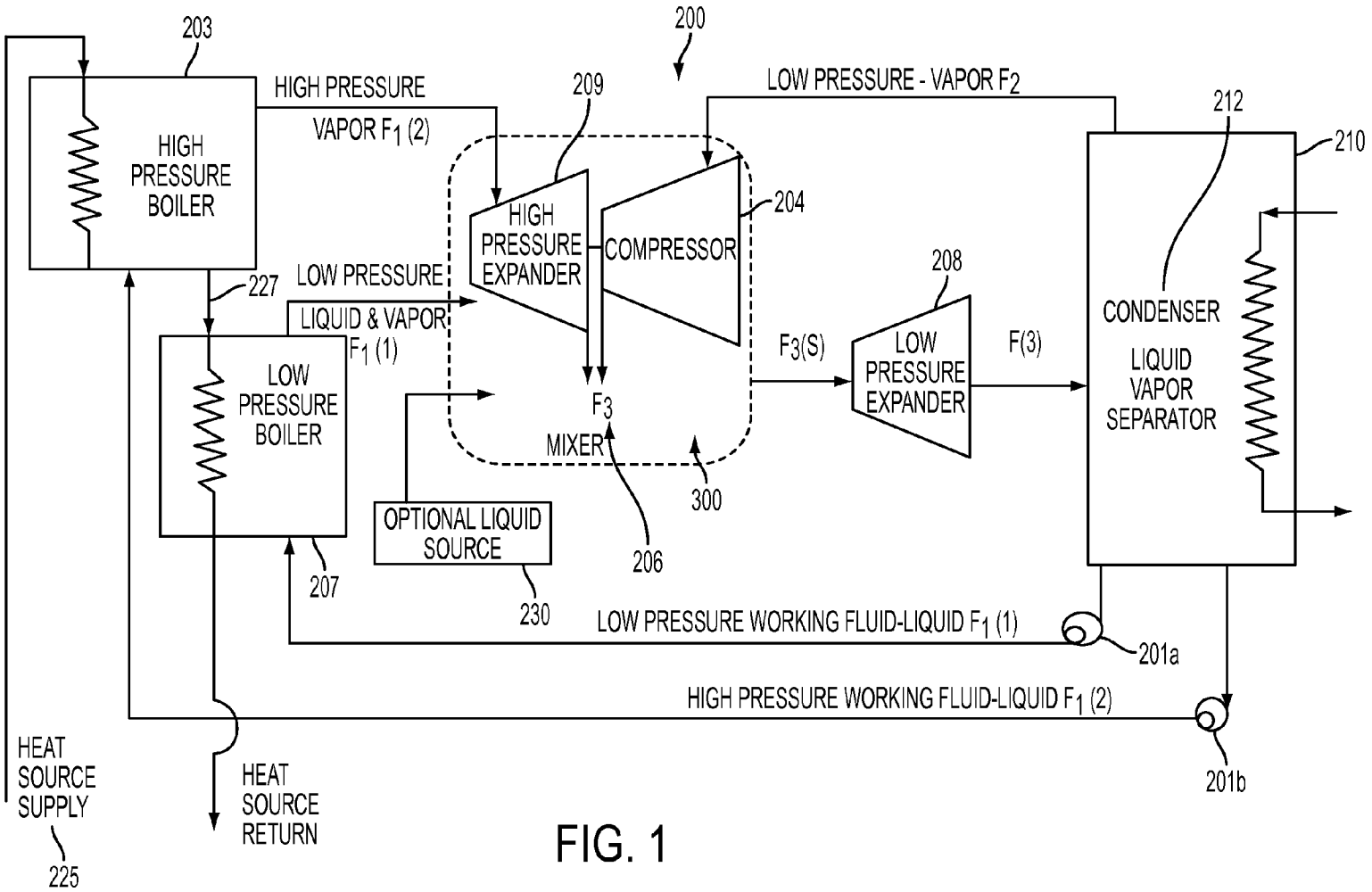
FIG. 1 is a schematic drawing that is useful for understanding a heat engine incorporating an exemplary combined mixer assembly in accordance with an embodiment of the invention.

An exemplary heat engine 200 incorporating the combined mixer assembly 300 is illustrated in FIG. 1. It should be appreciated that the heat engine shown is merely provided by way of example of a system incorporating the mixer assembly 300 and is not intended to limit the invention. Many variations of heat engines incorporating the inventive assembly are possible. Accordingly, heat engines incorporating the inventive assembly can include more or fewer components or steps and still remain within the scope of the invention.

The heat engine 200 makes use of a high temperature thermal source 225 and optionally a low temperature thermal source 227. The "high temperature" nomenclature which is used to describe thermal source 225 is intended to emphasize that such thermal source is at a higher temperature as compared to the temperature of low temperature thermal source 227. Although thermal source 225 will have a higher temperature compared to low temperature thermal source 227, it should be appreciated that high temperature thermal source 225 can actually have a relatively low temperature as compared to those temperatures which are normally used to provide efficient operation of a conventional heat engine. For example, in some embodiments, the high temperature thermal source 225 may actually only have a temperature of about 800° F. or less. In other embodiments, the high temperature thermal source 225 can have a temperature of about 400° F. or less. The ability to efficiently utilize such sources of heat is a significant advantage of the present invention.

Suitable choices for working fluids $F_1$ and $F_2$ will be described below in further detail. Still, given the anticipated temperatures for thermal source 225, 227, it can be advantageous to select the working fluid $F_1$ to be a low vapor state formulation to facilitate vaporization of such working fluid at relatively low temperatures. Examples of such low vapor state formulations can include fluids such as methanol or pentane.

A high pressure boiler 203 can use as its primary heat source a supply of steam from the high temperature thermal source 225. For example, the high temperature thermal source can be a geothermal well or waste heat from some high temperature process or other power generation system. The low temperature thermal source can be a thermal source that is entirely independent of the high temperature thermal source 225. However, it can be advantageous to select the optional low temperature thermal source 227 to be a downline flow from the high temperature thermal source 225, after such flow has provided a portion of its thermal energy to the high pressure boiler 203, as illustrated in FIG. 1. However, it is appreciated that a separate low temperature thermal source may be utilized.

The exemplary heat engine 200 also includes a low pressure boiler 207. The high pressure boiler 203 will generally have a higher internal operating pressure as compared to the optional low pressure boiler 207. However, it should be appreciated that high pressure boiler 203 can actually have a relatively low pressure as compared to those operating pressures which are normally used to provide efficient operation of a conventional heat engine. For example, in conventional heat engines, high pressure boilers typically are understood as boilers that operate in the range of 1000 to 3000 psi. In contrast, the high pressure boiler 203 can operate at a pressure in the range of 300 psi or less. Still, the invention is not limited in this regard and the actual operating pressure in the high pressure boiler 203 and optional low pressure boiler 207 can vary in accordance with the available heat source and other design conditions.

Referring again to FIG. 1, a first working fluid $F_1$ (in liquid form) is pressurized using a pump 201*a* and a first flow $F_1(1)$ of the working fluid $F_1$ fluid is communicated to the interior of the low pressure boiler 207. The low pressure boiler 207 can have a relatively low internal pressure as compared to the high pressure boiler 203. In a preferred embodiment of the invention, the pressure within the low pressure boiler 207 is maintained such that it is approximately equal to a vaporization pressure of $F_1$ at a temperature corresponding to the low temperature thermal source 227. The temperature in the low pressure boiler 207 is determined by the low temperature thermal source 227. The relatively low pressure and relatively low temperature within the low pressure boiler 207 facilitates vapor formation (sometimes referred to herein as $F_1(1)$ vapor). The $F_1(1)$ vapor from the low pressure boiler 207 is communicated to the combined mixer assembly 300, which will be discussed below in further detail. The $F_1(1)$ vapor will contain a certain amount of thermal potential energy (heat energy) when it enters into the mixer assembly 300.

A second flow $F_1(2)$ of a first liquid working fluid $F_1$ is pressurized using a pump 201*b*. It is understood that the pumps 201*a* and 201*b* may combined in a single pump. The pressurized fluid is communicated to the high pressure boiler 203 which is maintained at a relatively high temperature as determined by high temperature thermal source 225. The high pressure boiler 203 will add a predetermined amount of thermal energy to the $F_1(2)$ working fluid. As a result of these operations, the $F_1(2)$ working fluid is converted to a vapor (sometimes referred to herein as $F_1(2)$ vapor). The $F_1(2)$ vapor formed in high pressure boiler 203 is communicated to an expander 209 of the combined mixer assembly 300 where the thermal energy contained in the $F_1(2)$ vapor is used to perform work and thereafter the $F_1(2)$ flow of $F_1$ working fluid vapor is communicated to the mixing chamber 206 within the mixer assembly 300.

Additionally, the $F_2$ fluid mentioned above is also delivered to the mixer assembly 300 in a low pressure vapor form. The $F_2$ fluid passes through a compressor 204 within the mixer assembly 300 and then passes into the mixing chamber 206. The three separate vaporous fluid flows comprised of $F_1(1)$, $F_1(2)$ and $F_2$ are combined or mixed to form a vaporous mixture which is referred to herein as third working fluid $F_3$ (or $F_3$ vapor).

An exemplary embodiment of a combined mixer assembly 300 will be described with reference to FIGS. 2-8A. As will be described, the combined mixer assembly 300 combines the function of the compressor 204, the expander 209 and the mixing chamber 206 into a combined assembly. The invention is not limited to the specific combination of components and may include fewer or more components.

Figure 2:
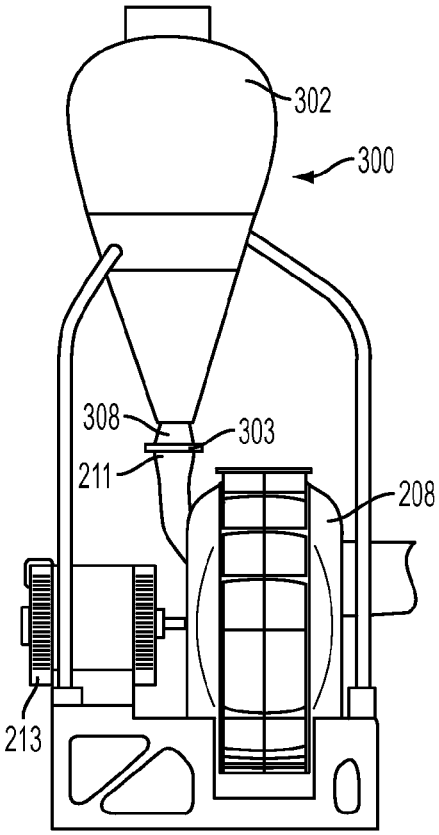
FIG. 2 is a front elevation view of an exemplary combined mixer assembly positioned relative to a low pressure expander.
Figure 3:
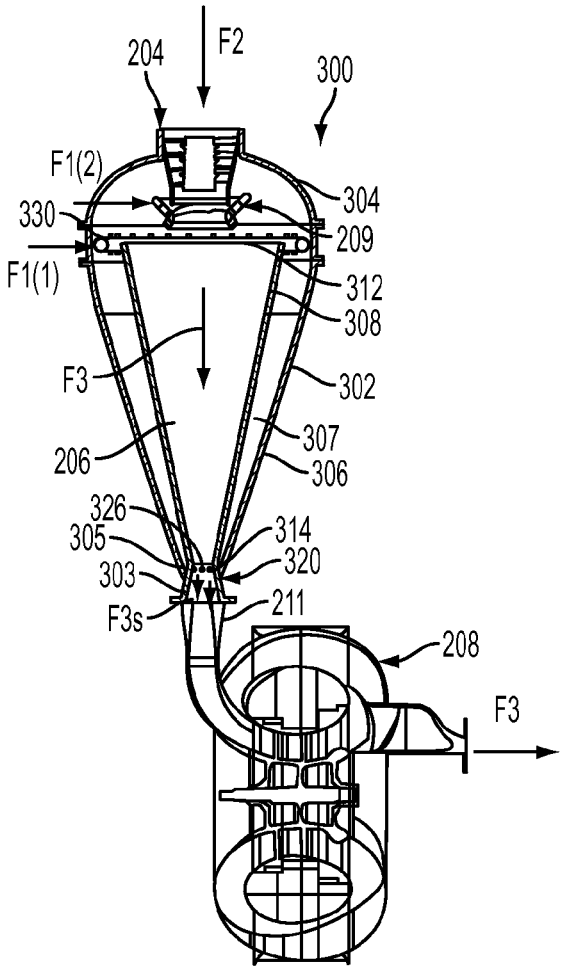
FIG. 3 is a cross-sectional view of the combined mixer assembly and expander of FIG. 2.
Figure 4:
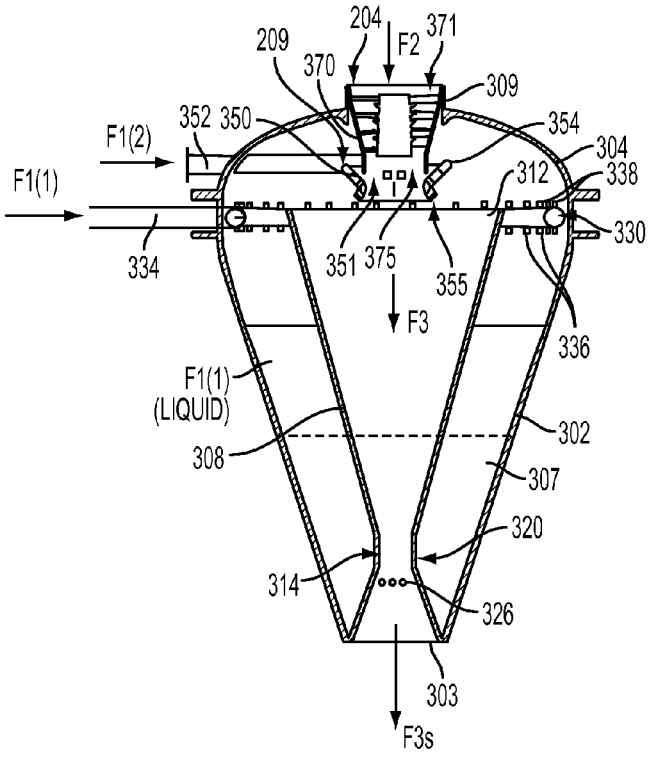
FIG. 4 is a cross-sectional view of the combined mixer assembly of FIG. 2.
Figure 5:
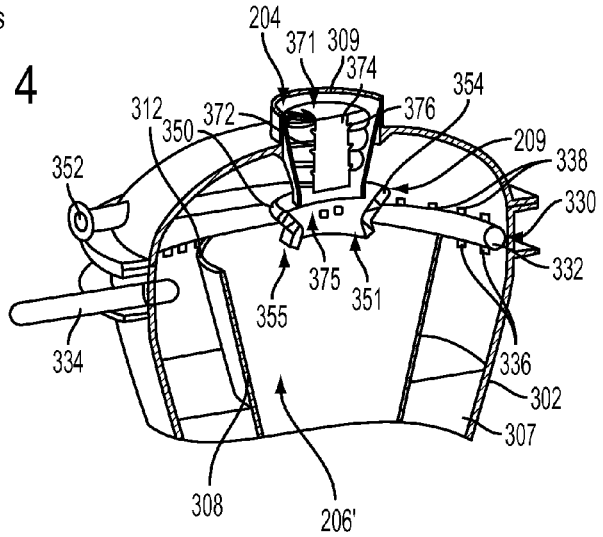
FIG. 5 is a partial isometric, cross-sectional view of the combined mixer assembly of FIG. 2.
Figure 6:
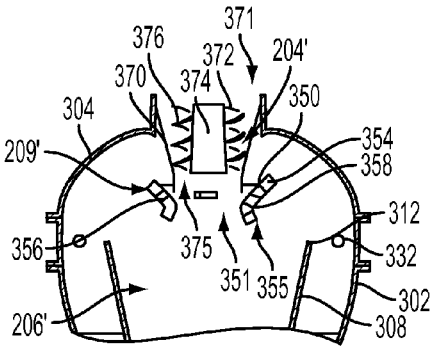
FIG. 6 is a partial schematic view of the combined mixer assembly of FIG. 2.

Referring to FIGS. 2 and 3, the exemplary combined mixer assembly 300 includes an outer housing 302 member and an inner housing member 308 with a portion of the inner housing member 308 extending beyond the outer housing member 302 to define an outlet 303. The outer housing member 302 and the inner housing member 308 are sealed at the lower junction 305 such that a fluid chamber 307 is defined between the housing members 302 and 308. The outlet 303 supplies the third working fluid $F_3$ to the expander 208. In the illustrated embodiment, the outlet 303 is directly connected with an inlet 211 of an expander 208. The expander 208 is illustrated with a generator 213, the function of which is well known and will not be described in more detail herein. The expander 208 and condenser 210 portions of the heat engine 200 will be described in more detail hereinafter.

The inner housing member 308 tapers from a wider open end 312 to a narrow throat area 314 before expanding to the outlet 303 such that the inner housing member 308 defines a nozzle section 320, the function of which will be described below. A vapor mixing chamber 206 is defined within the inner housing member 308, extending from the open end 312 to the throat area 314. Mixing of the $F_1(1)$(vapor), the $F_1(2)$ and the $F_2$ fluids will be described in more detail below. The lower portion 306 of the outer housing member 302 is illustrated with a corresponding taper such that the housing members 302 and 308 meet at the junction 305, however, the outer housing member 302 may be otherwise configured provided it seals with the inner housing member to define the fluid chamber 307. With reference to FIG. 8A, it is preferred that the junction 305 is below the narrow throat area 314 such that the fluid chamber 307 is in fluid communication with fluid passages 326 defined through the inner housing member 308 in the expanding portion thereof.

Figure 7:
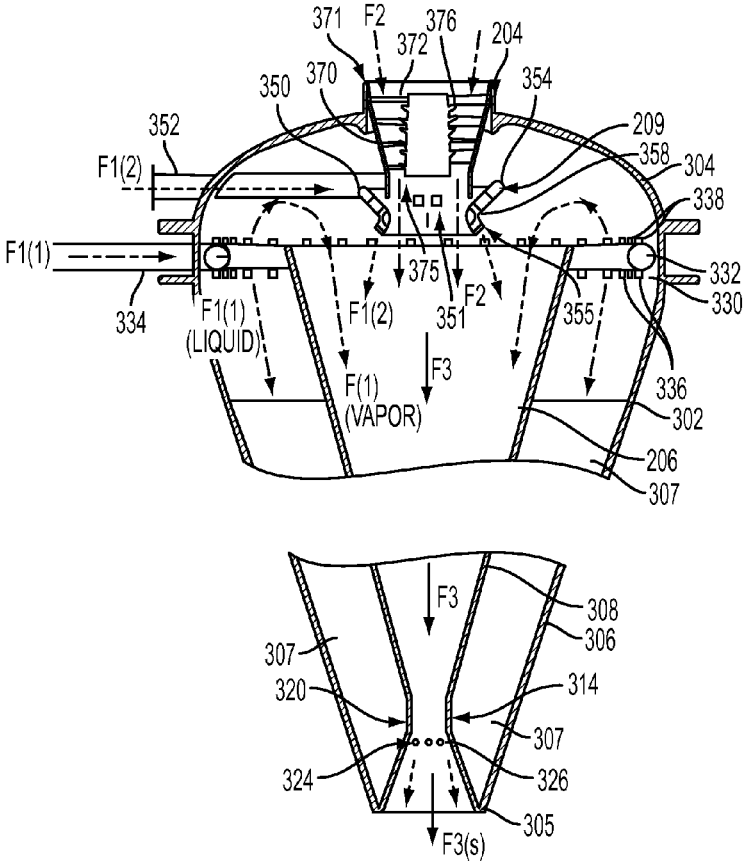
FIG. 7 is a cross-sectional view similar to FIG. 5 illustrating flow through the combined mixer assembly of FIG. 2.

Referring to FIGS. 3-6, the upper portion 304 of the outer housing member 302 supports the compressor 204, the expander 209 and a separation assembly 330. The separation assembly 330 includes an annular tubular member 332 extending inside the outer housing 302 with an inlet 334 which receives the $F_1(1)$ vapor from the low pressure boiler 207. The tubular member 332 is preferably positioned such that it is radially aligned with the fluid chamber 307 and positioned proximate to the open end 312 of the inner housing member 308. The exemplary tubular member 332 includes a plurality of liquid outlets 336 annularly spaced about the tubular member 332 and a plurality of vapor outlets 338 annularly spaced about the tubular member 332. As the relatively wet, highly saturated flow from the low pressure boiler 207 passes through the tubular member 332, liquid in the $F_1(1)$ flow is allowed to drop out of the flow and travels through the liquid outlets 336 and is collected in the fluid chamber 307 while the remaining vapor portion of the $F_1(1)$ flow travels through the vapor outlets 338 and into the mixing chamber 206 as illustrated in FIG. 7. In the illustrated embodiment, the mixer assembly 300 is oriented such that gravity directs the liquid flow to the fluid chamber 307, however, the invention is not limited to such. The mixer assembly 300 may be otherwise oriented and other means, for example, a pressure differential, may be utilized to direct the liquid to the fluid chamber 307.

The exemplary compressor 204 is an axial flow compressor with a housing 370 having an inlet 371 and an outlet 375 in axial alignment. The compressor housing 370 is supported by the outer housing member 302 at an opening 309 therethrough such that the inlet 371 receives the $F_2$ working fluid from the condenser 210. The housing 370 supports one or more internal stators 372. A shaft (not shown) drives a central drum 374 which has one or more annular blades 376. As is common in an axial flow compressor, the rotating blades accelerate the fluid while the stators convert the increased rotational kinetic energy into static pressure through diffusion and redirect the flow direction of the fluid, preparing it for the rotor blades of the next stage or to passage through the outlet 375. The housing 370 tapers inward moving from the inlet 371 to the outlet 375 to maintain optimum fluid properties as the fluid is compressed. The $F_2$ working fluid leaves the compressor outlet 375 at a higher temperature and pressure.

In the exemplary embodiment, the expander 209 includes a housing 350 which is connected to the compressor housing 370 such that a passage 351 through the expander housing 350 is aligned with the compressor outlet 375 such that the $F_2$ working fluid passes the expander 209 and enters the mixing chamber 206 as illustrated in FIG. 7. In the illustrated embodiment, the expander 209 is a radial inflow turbine. An inlet 352 is configured to receive the $F_1(2)$ working fluid and deliver it to a radial inlet 354 of the expander 209. Within the housing 350, the expander 209 includes an expander wheel 358 configured to expand the incoming fluid. Guide vanes 356 may also be provided within the housing 350. The expanded $F_1(2)$ working fluid exits from the expander outlet 355 and is directed to the mixing chamber 206 as indicated in FIG. 7.

The expander wheel 358 preferably shares a common shaft (not shown) with the compressor drum 374 such that rotation of the expander wheel 358 by the high pressure $F_1(2)$ working fluid facilitates rotation of the compressor blades 376. In this configuration, the integral compressor 204 and expander 209 act similar to a turbocharger, with the exception that both exit flows mix together in this apparatus. While the exemplary compressor 204 and expander 209 are assembled as an integrated structure, such is not necessary and the components may be separately positioned and operated.

The arrangement of the co-located compressor and expander can form low pressure zones at the exit flow thereof. The means of creating an exit flow environment of one flow relative to the other exit flow inherently improves the system performance of the flow relationship as the fluids $F_1$ and $F_2$ are mixed. More specifically, the arrangement uses the compressor flow to create a low pressure zone adjacent to the exit of the expander flow, thereby effectively lowers the expander exit pressure and increases the performance of the expander relative to the compressor. Similarly, the arrangement uses the expander flow to create a low pressure zone adjacent to the exit of the compressor flow, thereby effectively lowering the compressor exit pressure and increasing the performance of the compressor relative to the first expander.

Figure 8:
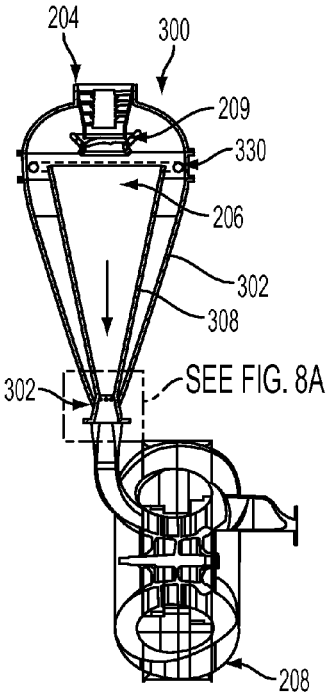
FIG. 8 is a cross-sectional view similar to FIG. 3
Figure 8A:
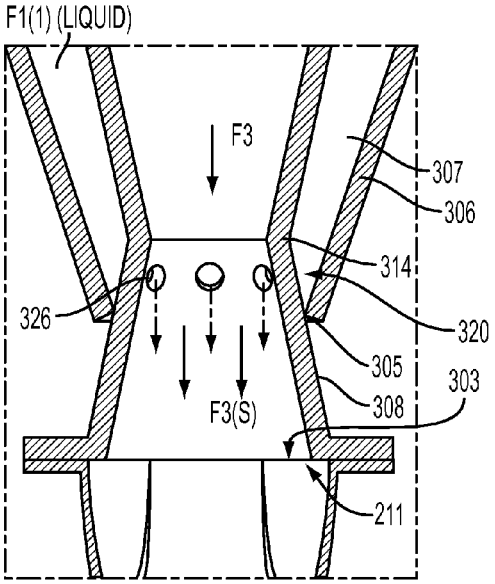
FIG. 8A is an expanded view of the nozzle section thereof.

Referring to FIGS. 7-8A, the $F_2$ vapor as well as the $F_1(1)$ and $F_1(2)$ vapors enter the mixing chamber 206, preferably at approximately the same pressure, and mix together to form the third working fluid $F_3$. As the $F_3$ working fluid travels toward the nozzle section 320, the configuration causes the flow to increase in speed as it passes through the nozzle section 320. As a result of the increase in speed, a low pressure zone 324 is formed after the narrowed throat 314. The fluid passages 326 are preferably positioned in this low pressure zone 324 such that the $F_1(1)$(liquid) passes through the passages 326 and is atomized and vaporized, at a lower apparent pressure, with the $F_3$ working fluid to form a saturated working fluid $F_3(S)$. While the exemplary mixer assembly 300 vaporizes and atomizes the $F_1(1)$(liquid) to form the $F_3(S)$ working fluid, such is not the only method. The liquid which is vaporized and atomized may be provided from a different source, for example, an optional external liquid source 230.

Not all of the $F_1(1)$(liquid) is vaporized, however, it has the resulting appearance of a vapor as the $F_3(S)$ working fluid actually contains micro droplets of the $F_1(1)$(liquid). More specifically, the surface tension of the $F_1(1)$(liquid) is lowered by the flow of the $F_3$ working fluid. As the $F_1(1)$(liquid) atomizes it also has the potential to vaporize as it can draw energy from the $F_3$ working fluid flow. Additionally, the liquid that is residual in the $F_3(S)$ working fluid realizes a lower pressure in that flow, a phenomena known as partial pressures. As such, the molecular portion of the liquid that becomes vaporous is capable of sharing the same space with the molecules that comprise the $F_3(S)$ working fluid flow.

The characteristics of the $F_3$ flow at the nozzle area 314 facilitate atomization and or vaporization of the introduced liquid portion. Such is facilitated by the relative low pressure state and high velocity of the $F_3$ flow at the nozzle area 314. As such, a flow shear environment or effectively a mechanical separation of the surface tension for the liquid entering the $F_3$ flow results where the $F_3$ flow effectively lowers the surface tension of the liquid mechanically enabling the process of atomization and/or vaporization and energy is transferred from the $F_3$ flow to the liquid having been atomized and/vaporized within the $F_3$ flow. More specifically, at least a portion of the liquid introduced becomes vaporous first by mechanical means and remains vaporous in the $F_3$ flow by acquisition of adjacent heat that is contained within the F3 flow. This is an inversion process that enables the $F_3$ flow to give up heat without collapsing to vapor.

As a result, the denser working fluid $F_3(S)$ is a fluid combination that for all intended purposes appears vaporous and comprises a much higher density relative to the initial vapor flow. The $F_3(S)$ working fluid flow is then provided to the low pressure expander 208 where it is useful in performing work on the turbine blade with an increased power. Such increased power results from the fact that the energy must be transferred from the $F_3(S)$ working fluid to the turbine blade. The equations (mathematics) that govern this transfer of energy are dominated by velocity of the flow and the density of the flow. It has been shown by experiment that the density of the flow can be increased while maintaining a suitable flow velocity, i.e., some velocity will be lost, however, the beneficial gain in density overshadows the velocity reduction in this application.

It is not necessary for all thermal energy transfer between the $F_1(1)$, $F_1(2)$ and $F_2$ vapor to occur within the mixing chamber 206. In some embodiments of the invention, a portion of such transfer can occur after the $F_3$ vapor exits the mixing chamber. For example, in an embodiment of the invention, at least a portion of such transfer can continue occurring as the $F_3$ vapor continues through an expansion cycle discussed below. Also, it is possible for the $F_1(1)$, $F_1(2)$ vapor, and the $F_2$ vapor fluids to enter the mixer at approximately the same temperatures and pressures. However, as a result of the different chemical compositions of such fluids, transfer or exchange of thermal energy as between them, can still potentially take place in a subsequent expansion cycle. Details of the expansion cycle are discussed below with regard to expander 208.

The vaporous third working fluid $F_3(S)$ is communicated under pressure from the mixer assembly 300 to expander 208 for performing useful work. Well known conventional expander technology can be used for purposes of implementing expander 208, provided that it is capable of using a pressurized vapor to perform useful work. For example, the expander 208 can be an axial flow turbine, custom turbo-expander, vane expander or reciprocating expander. Advantageously the expander 208 will be selected by those skilled in the art to provide high conversion efficiency based on the specific thermodynamic and fluid properties of $F_3(S)$ delivered to the expander for a particular embodiment of the cycle. Still, the invention is not limited in this regard.

After such work is performed by the expander 208, the $F_3$ working fluid is communicated from the expander to a condenser assembly 210 including a condenser 212. The condenser 212 can be any device capable of condensing at least a portion of the $F_1$ working fluid from its vapor state to its liquid state.

As is well known in the art, condensing is commonly performed by cooling the working fluid under designated states of pressure. This cooling process will generally involve a release of heat contained in the third working fluid $F_3$. The condenser cools the $F_3$ fluid and thereby facilitates the condensing of the $F_1$ fluid contained within the $F_3$ fluid mixture. The $F_1$ portion therefore drops out as a liquid in the form of condensate and is collected in the condenser as $F_1$ fluid (liquid), and is available for reuse. This process leaves a residual portion of the $F_3$ working fluid. The residual portion of $F_3$ is a remaining portion of the one or more fluids previously comprising $F_3$ that exist after the $F_1$ condensate has been extracted from $F_3$. With the $F_1$ (liquid) condensate and the residual portion of $F_3$ available separate, the process has essentially returned to its starting point. The residual portion of $F_3$ working fluid can be communicated directly to the compressor 204, where it comprises the exclusive constituent of $F_2$ working fluid. Thereafter, the entire process described above can be repeated in a continuous cycle.

The pressure, temperature and construct of the heated working fluid mixture $F_3(S)$ entering the expander is key for establishing the performance capability of the cycle. These factors include the constituent mass flow rates and therefore establish the parameters for the expansion rate and the design requirements of the expander 208. It is further understood that the expander performance is highly dependent on the energy content and expansion profile of the $F_3(S)$ flow. It would be understood by those skilled in the art that the volumetric flow rate, density, pressure, and temperature can be used to establish the performance characteristics and therefore provide the basis for the best expander design. These parameters can be established and controlled within the cycle construct for a broad range of applications where the cycle is designed around the available thermal source temperature and heat rate.

The first and second working fluids, and ratios thereof, should also be selected such that they work in concert with one another. In particular, the more rapid cooling of the second fluid (as compared to the first fluid) during the expansion process can facilitate the exchange of energy from the first fluid to the second fluid. This leaves the first fluid very close to the vapor to liquid transition point as it approaches the end of the expansion cycle. As the first working fluid condenses, it is therefore separated from the second working fluid and can be collected in the condenser. This unique fluid capability provides the means to tune the thermal take-up rates (heat addition/vaporization) and additionally the drop-out rates (condensate rates) of the fluids in operation.

Various examples of the operation of exemplary heat engine are provided in applicant's co-pending U.S. application Ser. No. 13/098,603, filed May 2, 2011; Ser. No. 13/239,674, filed Sep. 22, 2011; Ser. No. 13/477,394, filed May 22, 2012; Ser. No. 13/533,497, filed Jun. 26, 2012; and Ser. No. 13/556,387, filed on Jul. 24, 2012, each of which is incorporated herein by reference.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

What is claimed is:

1. A method for producing work from heat, the method comprising:

mixing a first working fluid $F_1$ vapor with a second working fluid $F_2$ vapor different from the first working fluid $F_1$ vapor to form a third working fluid $F_3$;

subsequent to said mixing, atomizing and/or vaporizing a liquid into the third working fluid $F_3$ to define a saturated working fluid $F_3(S)$; and expanding the saturated working fluid $F_3(S)$ to perform useful work.

2. The method according to claim 1, wherein the first working fluid $F_1$ vapor includes a low pressure $F_1(1)$ portion and a high pressure $F_1(2)$ portion.

3. The method according to claim 2, wherein the low pressure $F_1(1)$ portion of the first working fluid $F_1$ vapor is received from a low pressure boiler and the high pressure $F_1(2)$ portion of the first working fluid $F_1$ vapor is received from a high pressure boiler.

4. The method according to claim 2, further comprising expanding the high pressure $F_1(2)$ portion of the first working fluid $F_1$ vapor prior to the mixing step.

5. The method according to claim 4, further comprising compressing the second working fluid $F_2$ vapor prior to the mixing step.

6. The method according to claim 5, wherein the steps of compressing the second working fluid $F_2$ vapor and expanding the high pressure $F_1(2)$ portion of the first working fluid $F_1$ vapor are carried out by an integral compressor and expander assembly.

7. A method for producing work from heat, the method comprising:

mixing a first working fluid $F_1$ vapor with a second working fluid $F_2$ vapor to form a third working fluid $F_3$;

atomizing and/or vaporizing a liquid into the third working fluid $F_3$ to define a saturated working fluid;

expanding the saturated working fluid to perform useful work expanding the high pressure $F_1(2)$ portion of the first working fluid $F_1$ prior to the mixing step; and compressing the $F_2$ vapor prior to the mixing step;

wherein the $F_1$ vapor includes a low pressure $F_1(1)$ portion and a high pressure $F_1(2)$ portion of the first working fluid $F_1$;

wherein the steps of compressing the $F_2$ vapor and expanding the high pressure $F_1(2)$ portion of the first working fluid $F_1$ are carried out by an integral compressor and expander assembly; and wherein the integral compressor and expander assembly are positioned within a combined mixer assembly with an internal mixing chamber and outlets of both the compressor and expander are directed toward the mixing chamber.

8. The method according to claim 7, wherein the arrangement of the compressor and expander outlets form an area of vortex mixing.

9. The method according to claim 8, wherein flow from the compressor outlet creates a low pressure zone adjacent to the expander outlet whereby the exit pressure at the expander outlet is effectively lowered.

10. The method according to claim 8, wherein flow from the expander outlet creates a low pressure zone adjacent to the compressor outlet whereby the exit pressure at the compressor outlet is effectively lowered.

11. A method for producing work from heat, the method comprising:

mixing a first working fluid $F_1$ vapor with a second working fluid $F_2$ vapor to form a third working fluid $F_3$;

atomizing and/or vaporizing a liquid into the third working fluid $F_3$ to define a saturated working fluid; and expanding the saturated working fluid to perform useful work wherein the $F_1$ vapor includes a low pressure $F_1(1)$ portion and a high pressure $F_1(2)$ portion of the first working fluid $F_1$; and wherein the liquid is a portion of the low pressure $F_1(1)$ portion of the first working fluid $F_1$.

12. A method for producing work from heat, the method comprising:

mixing a first working fluid $F_1$ vapor with a second working fluid $F_2$ vapor to form a third working fluid $F_3$;

atomizing and/or vaporizing a liquid into the third working fluid $F_3$ to define a saturated working fluid; and expanding the saturated working fluid to perform useful work;

wherein the liquid is received from a liquid source independent of the first working fluid $F_1$ and the second working fluid $F_2$.

13. A method for producing work from heat, the method comprising:

mixing a first working fluid $F_1$ vapor with a second working fluid $F_2$ vapor to form a third working fluid $F_3$;

atomizing and/or vaporizing a liquid into the third working fluid $F_3$ to define a saturated working fluid; and expanding the saturated working fluid to perform useful work;

wherein the flow characteristics of the third working fluid $F_3$ facilitate atomization and/or vaporization of the introduced liquid.

14. The method according to claim 10, wherein the flow characteristics of the third working fluid $F_3$ include a relative low pressure state and a generally maximized flow velocity.

15. The method according to claim 10, wherein the atomization and/or vaporization of the liquid is facilitated by providing a flow shear environment wherein the $F_3$ flow effectively lowers the surface tension of the liquid mechanically enabling the process of atomization and/or vaporization.

16. The method according to claim 1, wherein energy is transferred from a first $F_3$ flow to the liquid as the liquid is atomized and/or vaporized within the $F_3$ flow subsequent to the introduction, then transferring the energy from the $F_3$ flow combined, to the expander apparatus having a greater flow density.

17. The method according to claim 13, wherein at least a portion of the introduced liquid becomes vaporous first by mechanical means and remains vaporous in an $F_3$ flow by acquisition of adjacent heat that is contained within the $F_3$ flow.

18. A system for producing work from heat in a fluid flow, comprising:

a mixing chamber configured to (a) mix a first working fluid $F_1$ vapor with a second working fluid $F_2$ vapor different from the first working fluid $F_1$ vapor to form a third working fluid $F_3$ and (b) facilitate a transfer of thermal energy directly between the first working fluid $F_1$ vapor and the second working fluid $F_2$ vapor, exclusive of any intervening structure;

a nozzle assembly configured to vaporize and/or atomize a liquid into the third working fluid $F_3$ to form a saturated working fluid $F_3(S)$; and an expander configured to expand the saturated working fluid $F_3(S)$ to perform work.

19. The system according to claim 18, further comprising an initial expander configured to expand a portion $F_1(2)$ of the first working fluid $F_1$ vapor before it is communicated to the mixing chamber and a compressor configured to compress the second working fluid $F_2$ vapor before it is communicated to the mixing chamber.

20. The system according to claim 19, wherein the compressor and the initial expander are an integral unit.

21. A system for producing work from heat in a fluid flow comprising:

a mixing chamber configured to mix a first working fluid $F_1$ vapor with a second working fluid $F_2$ vapor to form a third working fluid $F_3$ and to facilitate a transfer of thermal energy directly between the $F_1$ vapor and the $F_2$ vapor, exclusive of any intervening structure;

a nozzle assembly configured to vaporize and/or atomize a liquid into the third working fluid $F_3$ to form a saturated working fluid; and an expander configured to expand the saturated working fluid to perform work; and an initial expander configured to expand a portion $F_1(2)$ of the first working fluid $F_1$ before it is communicated to the mixing chamber and a compressor configured to compress the $F_2$ working fluid before it is communicated to the mixing chamber;

wherein the compressor and the initial expander are an integral unit; and wherein the integral compressor and expander assembly are positioned within an outer housing member of a combined mixer assembly and wherein an inner housing member thereof defines the mixing chamber, and wherein outlets of both the compressor and expander are directed toward the mixing chamber.

22. The system according to claim 21, further comprising a liquid separator configured to separate a liquid from a portion $F_1(1)$ of the first working fluid $F_1$ and the separated liquid is utilized as the liquid in the nozzle assembly.

23. The system according to claim 22, wherein a space between the inner housing member and the outer housing member defines a chamber configured to receive the separated liquid.

24. The system according to claim 23, wherein the combined mixer assembly is arranged such that gravity feeds the liquid to the nozzle assembly.

* * * * *